US011641926B2

(12) United States Patent
Sasaki et al.

(10) Patent No.: US 11,641,926 B2
(45) Date of Patent: May 9, 2023

(54) COATING MATERIAL, FEEDING CONTAINER

(71) Applicant: TOKIWA CORPORATION, Gifu (JP)

(72) Inventors: Arata Sasaki, Saitama (JP); Hiroya Yoshihara, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 17/669,921

(22) Filed: Feb. 11, 2022

(65) Prior Publication Data

US 2022/0265027 A1 Aug. 25, 2022

(30) Foreign Application Priority Data

Feb. 25, 2021 (JP) ..... JP2021-028777

(51) Int. Cl.
*A45D 40/20* (2006.01)

(52) U.S. Cl.
CPC ..... *A45D 40/205* (2013.01); *A45D 2040/208* (2013.01)

(58) Field of Classification Search
CPC ..... A45D 40/205; A45D 2040/208; A45D 40/20; A45D 2040/201; A45D 40/04; A45D 40/06; A45D 40/12; A45D 40/02
USPC ..... 401/171–174, 75, 78
See application file for complete search history.

(56) References Cited

U.S. PATENT DOCUMENTS

2012/0288321 A1* 11/2012 Ishida ..... A45D 40/205 401/75
2015/0030371 A1* 1/2015 Tani ..... A45D 40/04 401/75

FOREIGN PATENT DOCUMENTS

JP 3169255 U 6/2011
JP 2012-235885 A 12/2012

* cited by examiner

*Primary Examiner* — David J Walczak
(74) *Attorney, Agent, or Firm* — Greenblum & Bernstein, P.L.C.

(57) ABSTRACT

A coating material feeding container has a configuration in which a first projection is provided on an outer surface of a tubular member, at least one second projection is provided on an inner surface of a container rear portion, the tubular member has a small-diameter portion that projects inward in a radial direction of the tubular member and is engaged with a movable body, the movable body has an insertion portion that is inserted in and passed through a tube hole of the tubular member and is engaged with the small-diameter portion, the insertion portion has a cut surface that is engaged with an inner surface of the small-diameter portion and extends in the tube hole in an axial direction of the tube hole, and the tube hole has a space portion between the first projection and the cut surface.

7 Claims, 12 Drawing Sheets

COATING MATERIAL, FEEDING CONTAINER

CROSS-REFERENCE TO RELATED APPLICATIONS

This application claims the benefit of priority from Japanese patent Application No. 2021-28777, filed on Feb. 25, 2021, the entire contents of which are incorporated herein by reference.

BACKGROUND

The present disclosure relates to a coating material feeding container for feeding a coating material.

As a coating material feeding container for feeding a coating material, there have hitherto been known a variety of kinds. Japanese Patent Laid-open No. 2012-235885 describes a rod-shaped cosmetic material feeding container. The rod-shaped cosmetic material feeding container includes a tip tube accommodating a rod-shaped cosmetic material, a container main body engaged with the tip tube in a relatively rotatable manner, a female screw member engaged with the tip tube in a synchronously rotatable manner in the inside of the tip tube, and a movable body screw-engaged with the female screw member to advance attendant on relative rotation of the tip tube and the container main body. A spring member click-engaged with the female screw member is further provided on a rear side of the female screw member. The spring member has a tubular shape opening at both ends, and a spiral spring portion having elasticity for contracting in an axial direction of the spring member to absorb an impact is formed at an intermediate portion of the spring member in the axial direction.

The movable body is disposed on the rear side of the rod-shaped cosmetic material, and a piston body that makes close contact with the inside of the tip tube and pushes out the rod-shaped cosmetic material is provided between the movable body and the rod-shaped cosmetic material. The rod-shaped cosmetic material is a gel material used for an eyeliner and contains a cosmetic volatile oil. An accommodating portion of the tip tube is directly filled with the volatile rod-shaped cosmetic material, and the volatile rod-shaped cosmetic material is accommodated in the state of making close contact with an inner surface of the tip tube.

Japanese Utility Model Registration No. 3169255 describes a volatile rod-shaped cosmetic material feeding container. The volatile rod-shaped cosmetic material feeding container includes a tip tube accommodating a volatile cosmetic material, and a container main body engaged with the tip tube in a relatively rotatable manner. The tip tube is engaged with the container main body to such an extent as not to be disengaged in the axial direction at the time of relative rotation with the container main body, and the tip tube can be disengaged from the container main body when a certain degree of force is exerted in the axial direction at the time of replacement of the tip tube.

The volatile rod-shaped cosmetic material feeding container includes a piston body that slides in the inside of the tip tube, a female screw member synchronously rotatable with the tip tube in the inside of the tip tube, a spring member rotated synchronously with the container main body in the inside of the container main body, and a movable body screw-coupled with the female screw member to advance attendant on relative rotation of the tip tube and the container main body. The spring member is ratchet-engaged with the female screw member. The spring member has a tubular shape opening at both ends. A spiral spring portion contracted in the axial direction of the spring member to absorb an impact is formed at an intermediate portion of the spring member in the axial direction.

SUMMARY

The coating material feeding container and the volatile rod-shaped cosmetic material feeding container mentioned above are demanded to be filled with a larger amount of a coating material such as a cosmetic material. However, in the coating material feeding container, the female screw member and the spring member are disposed inside the container main body, and the spring portion is formed at an intermediate portion of the spring member in the axial direction. The spring portion contracts in the axial direction to absorb an impact. Therefore, a region in which to dispose the spring member that contracts and extends in the axial direction needs to be secured inside the container main body, and thus, a coating material long in the axial direction cannot be loaded in the container, so that a problem may arise in which the container cannot be filled with a larger amount of a coating material. In addition, from the viewpoint of ease of holding or the like, it may be demanded for the coating material feeding container to be compact.

It is an object of the present disclosure to provide a coating material feeding container which can be filled with a larger amount of a coating material and can be made compact.

A coating material feeding container according to the present disclosure is a coating material feeding container including a tubular container front portion, a tubular container rear portion rotatable with respect to the container front portion, a movable body that is disposed on a rear side of a coating material located inside the container front portion and has a male screw at an outer peripheral portion thereof, a tubular female screw member that is located inside the container rear portion and has a female screw for screw engagement with the male screw at an inner peripheral portion thereof, and a tubular member that is disposed inside the container rear portion between the container front portion and the female screw member. A screw engagement action of the male screw and the female screw functions, attendant on relative rotation of the container front portion and the container rear portion, such that the movable body advances with respect to the female screw member, to thereby feed the coating material from the container front portion. A first projection is provided on an outer surface of the tubular member. At least one second projection for engagement with the first projection in a rotating direction of the container rear portion is provided on an inner surface of the container rear portion. The first projection has elasticity in a radial direction of the tubular member by a through-hole that penetrates the tubular member in a periphery of the first projection in the radial direction. The tubular member has a small-diameter portion that projects inward in the radial direction of the tubular member and is engaged with the movable body. The movable body has an insertion portion that is inserted in and passed through a tube hole of the tubular member and is engaged with the small-diameter portion. The insertion portion has a cut surface that is engaged with an inner surface of the small-diameter portion and extends in the tube hole in an axial direction of the tube hole. The tube hole has a space portion for allowing the first projection to be displaced inward in the radial direction, between the first projection and the cut surface.

In the coating material feeding container, the tubular container front portion and the tubular container rear portion are engaged with each other in a relatively rotatable manner. The coating material is disposed inside the container front portion, and the movable body having the male screw at the outer peripheral portion thereof is disposed on the rear side of the coating material. The tubular female screw member including the female screw for screw engagement with the male screw of the movable body is disposed inside the container rear portion. When the container front portion and the container rear portion are relatively rotated, the screw engagement action of the male screw of the movable body and the female screw of the female screw member functions to cause the movable body to advance with respect to the female screw member, and the advancing movable body pushes out the coating material disposed inside the container front portion forward, so that the coating material is fed from the container front portion. The tubular member having the first projection on the outer surface thereof is disposed inside the container rear portion between the container front portion and the female screw member. The through-hole is formed in the periphery of the first projection in the tubular member, and thus, the first projection has elasticity in the radial direction by the through-hole. In other words, the first projection is elastically deformable along the radial direction of the tubular member. The at least one second projection for engagement with the first projection in the rotating direction is formed on the inner surface of the container rear portion. The tubular member has the small-diameter portion projecting inward in the radial direction, and the movable body inserted in and passed through the tube hole of the tubular member is engaged with the small-diameter portion. The movable body has the insertion portion which is inserted in and passed through the tube hole of the tubular member and is engaged with the small-diameter portion. The insertion portion has the cut surface which is engaged with the inner surface of the small-diameter portion and extends in the tube hole in the axial direction. The space portion for allowing the first projection to be elastically deformed inward in the radial direction is formed in the tube hole between the first projection and the cut surface of the movable body. Therefore, the first projection of the tubular member is engaged with one of the at least one second projection of the container rear portion on the inner side of the second projection in the radial direction, and the cut surface of the movable body is disposed on the inner side of the first projection in the radial direction, so that the length of the tubular member in the axial direction can be made small. Therefore, by disposing the tubular member small in the length in the axial direction, the coating material long in the axial direction can be loaded in the container, so that the container can be filled with a larger amount of the coating material. In addition, the length in the axial direction of the tubular member which is engaged with the container rear portion and the movable body is suppressed, so that the coating material feeding container can be made compact.

Further adoptable may be a configuration in which the tubular member has a fixed portion fixed to the container front portion, a cross section of the fixed portion orthogonal to the axial direction is non-circular in shape, the container front portion has a fixing portion to which the fixed portion is fixed, and a cross section of the fixing portion orthogonal to the axial direction is similar in shape to the cross section of the fixed portion orthogonal to the axial direction. In this case, when the fixed portion of the tubular member is fixed to the fixing portion of the container front portion, the fixed portion is fitted into the non-circular fixing portion, so that the tubular member can be engaged with the container front portion in a synchronously rotatable manner.

The coating material may be hardened in a state of making close contact with an inner surface of the container front portion. In this case, since the coating material is in close contact with the inner surface of the container front portion, even a soft coating material can be more securely protected in the inside of the container front portion.

The first projection and the at least one second projection may constitute a ratchet mechanism that permits relative rotation in one direction of the container front portion and the container rear portion but restricts relative rotation in another direction opposite to the one direction. In this case, the movable body advances attendant on the relative rotation in the one direction of the container front portion and the container rear portion, and the relative rotation in the other direction is restricted by the ratchet mechanism. Therefore, the relative rotation in the other direction of the container front portion and the container rear portion and unintended retraction of the coating material and the movable body can be restricted.

The first projection may be normally in contact with one of the at least one second projection to thereby normally generate a resistance between the tubular member and the container rear portion. In the case where the first projection projecting from the outer surface of the tubular member is normally in contact with one of the at least one second projection projecting from the inner surface of the container rear portion, a resistance can be normally generated between the tubular member and the container rear portion and, therefore, backlash of the tubular member and the container rear portion can be restrained.

According to the present disclosure, the coating material feeding container can be filled with a larger amount of a coating material and can be made compact.

DETAILED DESCRIPTION

Figure 1:
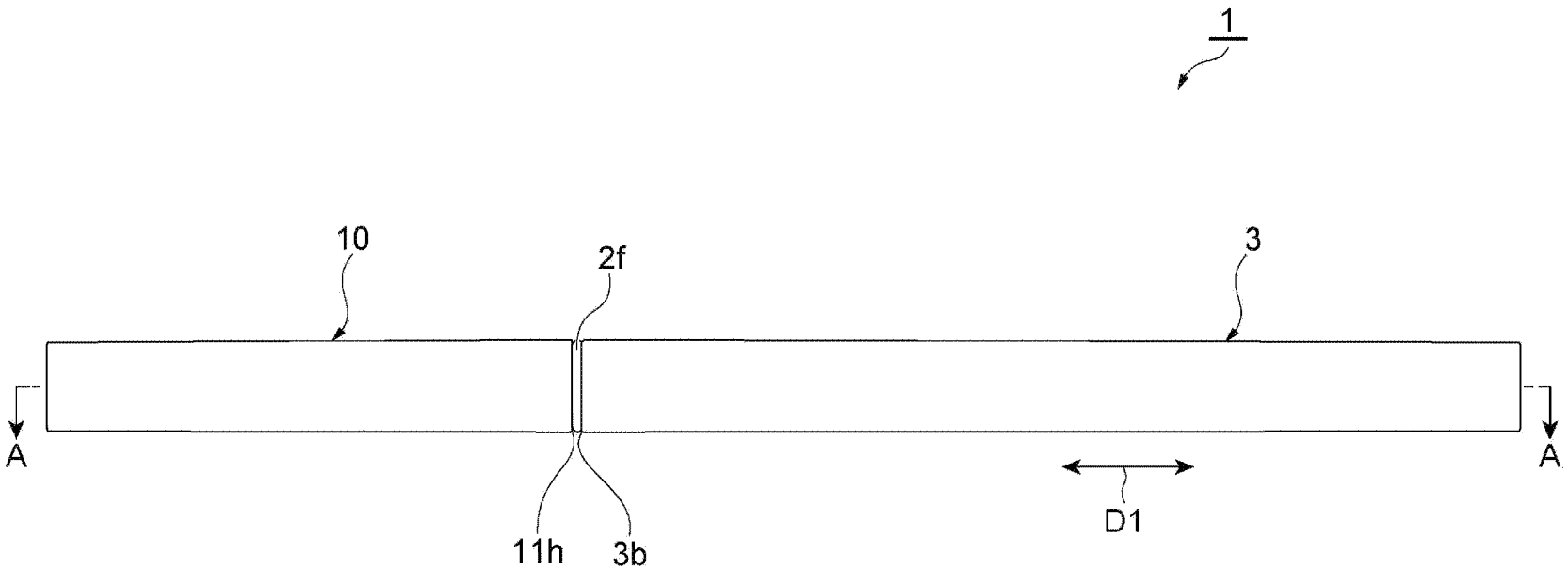
FIG. 1 is a side view depicting a coating material feeding container according to an embodiment.

A coating material feeding container according to an embodiment of the present disclosure will be described below referring to the drawings. In the description of the drawings, the same or equivalent elements are denoted by the same reference symbols, and overlapping description is omitted as required.

Figure 2:
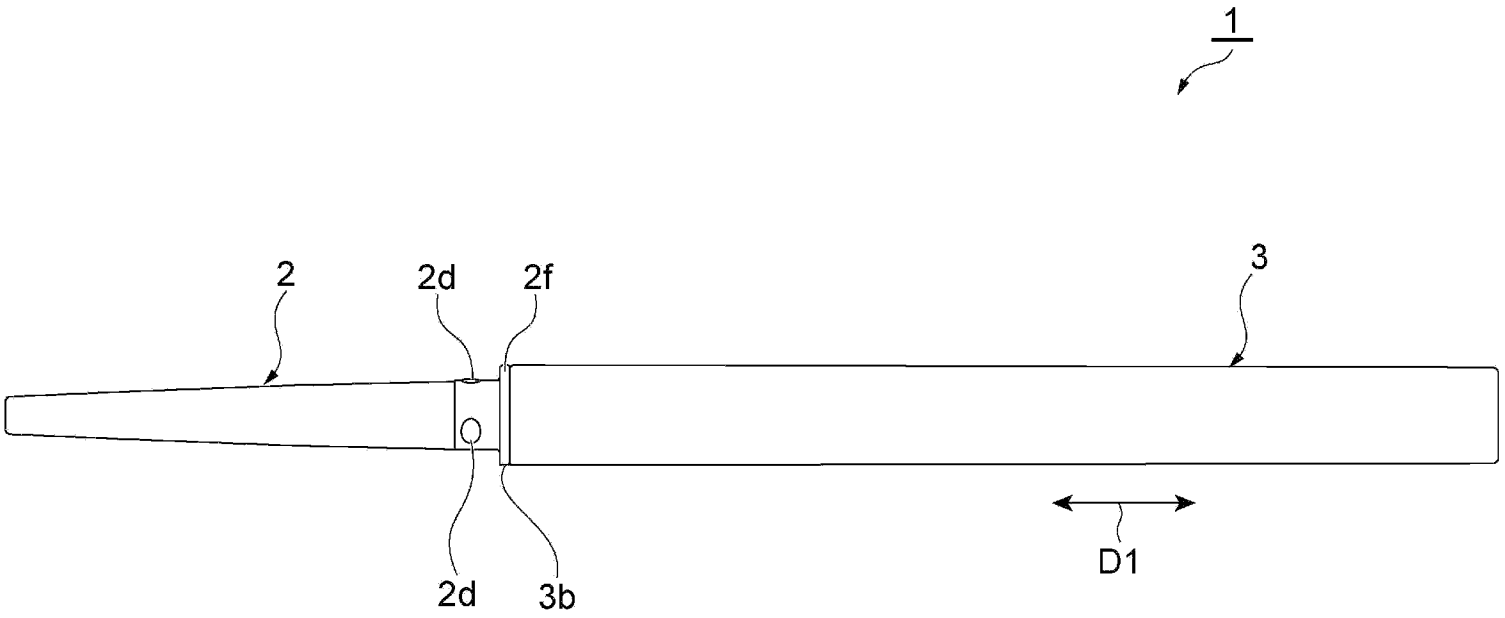
FIG. 2 is a side view depicting a state in which a cap has been detached from the coating material feeding container of FIG. 1.
Figure 3:
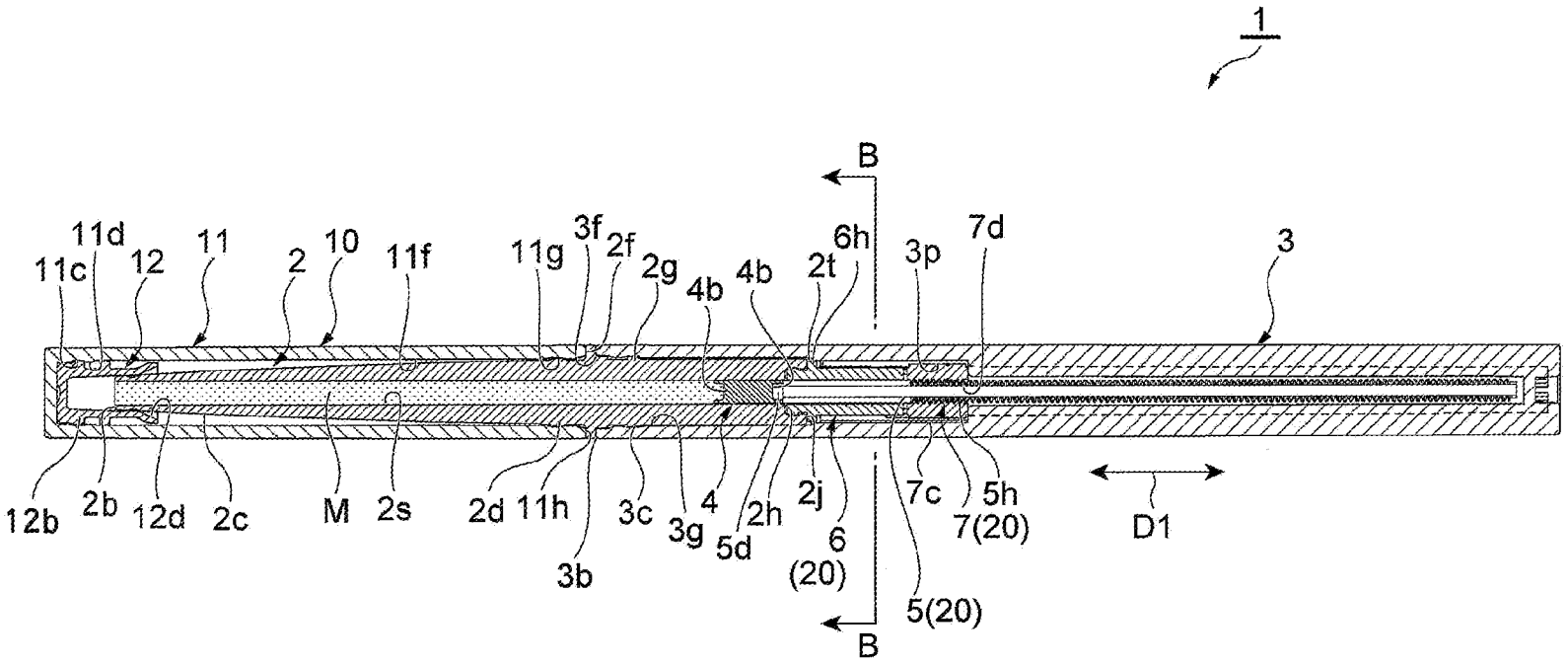
FIG. 3 is a cross-sectional view of the coating material feeding container of FIG. 1, taken along line A-A.

FIG. 1 is a side view of the coating material feeding container according to the embodiment. FIG. 2 is a side view depicting a state in which a cap has been detached from the coating material feeding container of FIG. 1. FIG. 3 is a cross-sectional view taken along line A-A of FIG. 1. As illustrated in FIGS. 1 to 3, a coating material feeding container 1 according to the present embodiment is, for example, a pencil-type container that feeds (pushes out) a coating material M accommodated in a container front portion 2 by a user's operation.

The coating material M is, for example, a cosmetic material. The coating material M is one used as, for example, a lip liner, a lipstick, a lip gloss, an eyebrow pencil, an eyeliner, a cosmetic stick, or a concealer. The coating material M may be a very soft (for example, semi-solid, soft solid, soft, jelly, mousse, paste containing these, or the like) rod-shaped material. Further, the coating material M may be a small-diameter rod-shaped material having an outside diameter of equal to or less than 1.5 mm, a general rod-shaped material having an outside diameter of 1.5 to 3.0 mm, or a large-diameter rod-shaped material having an outside diameter of equal to or more than 4.0 mm.

The coating material feeding container 1 includes the tubular container front portion 2, in which the coating material M is accommodated, and a tubular container rear portion 3, which is connected to one end in an axial direction D1 of the container front portion 2 and is engaged with the container front portion 2. Further, the coating material feeding container 1 includes a cap 10 attached to the container front portion 2. At the time of use of the coating material feeding container 1, the cap 10 is detached, and the container front portion 2 and the container rear portion 3 are put into relative rotation in one direction to push out the coating material M from the container front portion 2.

The cap 10 includes a bottomed cylindrical outer cap 11, and a stepped cylindrical inner cap 12 held by a bottom portion of the outer cap 11. The outer cap 11 has an annular recess 11*c* and an annular projection 11*d* at an inner surface thereof. The outer cap 11 is a part into which the container front portion 2 is inserted. The outer cap 11 has an inner circumferential surface 11*f*, and the inner circumferential surface 11*f* is formed with a recess 11*g* for engagement with the container front portion 2.

The inner cap 12 has an annular projection 12*b* at an outer circumferential surface thereof, and the annular projection 12*b* coming over the annular projection 11*d* is fitted into the annular recess 11*c*, so that the inner cap 12 is fixed to the outer cap 11. The inner cap 12 is provided for securing hermetical sealing of the coating material M that is located inside the container front portion 2 when the cap 10 is attached to the container front portion 2. The inner cap 12 has a tubular insertion portion 12*d* into which the container front portion 2 is inserted.

In the present disclosure, the "axis" is an axis of the tubular body and refers to a center line of the coating material feeding container extending in a longitudinal direction of the coating material feeding container. The "axial direction" is the longitudinal direction of the coating material feeding container and refers to the direction along the axis. The "front," "front side," and "forward" refer to a direction from the container rear portion 3 toward the container front portion 2 in the axial direction, while the "rear," "rear side," and "rearward" refer to a direction from the container front portion 2 toward the container rear portion 3 in the axial direction. The "radial direction" refers to a direction orthogonal to the axis, and the "rotating direction" refers to a direction along a circle (for example, circumferential direction) with the axis as a center. In the present disclosure, a feeding direction of the coating material M is the front side (advancing direction), and the opposite direction is the rear side (retracting direction).

Inside the container front portion 2, there are disposed a piston 4 that pushes out the coating material M to an exterior, a movable body 5 that moves the piston 4 forward, and a tubular member 6 into which the movable body 5 is inserted. A tubular female screw member 7 is located on the rear side of the tubular member 6. The movable body 5 is disposed in the tubular member 6 and the female screw member 7 located inside the container rear portion 3, in such a manner as to extend in the axial direction D1.

Figure 4:
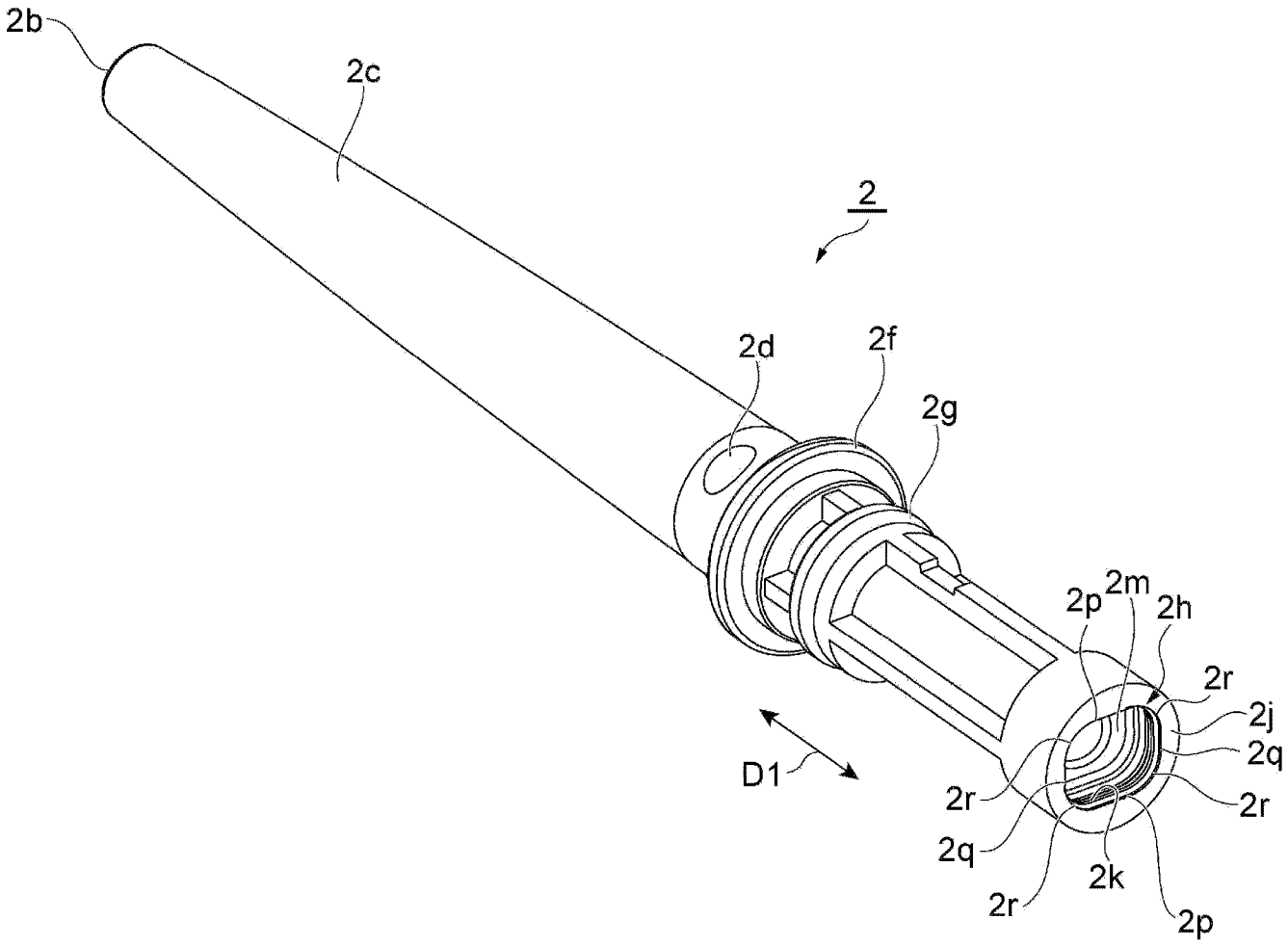
FIG. 4 is a perspective view depicting a container front portion of the coating material feeding container of FIG. 1.

FIG. 4 is a perspective view depicting the container front portion 2. The container front portion 2 includes, for example, a polybutylene terephthalate (PBT) resin. As depicted in FIGS. 3 and 4, the container front portion 2 has an opening 2*b* located at one end in the axial direction D1, and a tapered surface 2*c* inclined such that the container front portion 2 is enlarged in diameter as going away from the opening 2*b*. The opening 2*b* is a part where the coating material M in the container front portion 2 is exposed. At the time of use of the coating material M, the coating material M is caused to project from the opening 2*b*. The tapered surface 2*c* extends, for example, from the opening 2*b* to a position closer to the rear end than the center of the container front portion 2 in the axial direction D1.

The container front portion 2 has a projection 2*d* for mounting the cap 10 (outer cap 11). The projection 2*d* is, for example, circular in shape. The projection 2*d* is, for example, formed on the rear side of the tapered surface 2*c*. By a process in which the tapered surface 2*c* is fitted into the outer cap 11 and the projection 2*d* is engaged with the recess 11*g* of the outer cap 11, the cap 10 is mounted to the container front portion 2.

The container front portion 2 has a guard portion 2*f* formed at a position on the more rear side than the center of the container front portion 2 in the axial direction D1. The guard portion 2*f* is a part that an end surface 11*h* of the cap 10 (outer cap 11) and an end surface 3*b* of the container rear portion 3 each face along the axial direction D1. The container front portion 2 has an annular projection 2*g* projecting outward in the radial direction of the container front portion 2. By engagement of the annular projection 2*g* with an annular recess 3*c* formed in an inner surface 3*g* of the container rear portion 3, the container front portion 2 is engaged with the container rear portion 3 in a relatively rotatable manner.

The container front portion 2 has a fixing portion 2*h* to which the tubular member 6 is fixed. The fixing portion 2*h* is, for example, provided at an end surface 2*j* located at one end (rear end) of the container front portion 2 in the axial direction D1. The fixing portion 2*h* is in a form recessed from the end surface 2*j* of the container front portion 2. The fixing portion 2*h* has an inside surface 2*k* extending in the axial direction D1 from the end surface 2*j*, and a bottom surface 2*m* located on the opposite side of the inside surface 2*k* from the end surface 2*j*. Into a region defined by the inside surface 2*k* and the bottom surface 2*m* of the fixing portion 2*h*, the tubular member 6 is inserted and fixed.

The shape of the fixing portion 2*h* as viewed along the axial direction D1 is non-circular. For example, the shape of the fixing portion 2*h* as viewed along the axial direction D1 is a corner-rounded rectangle. The fixing portion 2*h* has a pair of first straight line portions 2*p* extending in parallel to each other, a pair of second straight line portions 2*q* extending in parallel to each other in a direction different from the first straight line portions 2*p*, and four curved portions 2*r* curved to the outside of the fixing portion 2*h* between the first straight line portions 2*p* and the second straight line portions 2*q*. The tubular member 6 is fixed to the fixing portion 2*h*, so that the container front portion 2 is engaged with the tubular member 6 in the rotating direction (in a synchronously rotatable manner).

On an inner surface 2*s* of the container front portion 2, there are disposed the coating material M and the piston 4. The inner surface 2*s* indicates an inner circumferential surface that has a tube-hole shape and penetrates the container front portion 2 along the axial direction D1, and, for example, a rear end of the inner surface 2*s* communicates with the fixing portion 2*h*. The inner surface 2*s* is, for example, a smooth surface. As a result, pushing-out of the coating material M by the movable body 5 and the piston 4 can be performed smoothly.

The coating material M is a volatile rod-shaped cosmetic material as an example. The coating material M is, for example, formed by directly being loaded into the inner surface 2*s* of the container front portion 2 and is accommodated in the container front portion 2 in the state of making close contact with the inner surface 2*s* of the container front portion 2. The coating material M is hardened in the state of making close contact with the inner surface 2*s* of the container front portion 2.

The piston 4 includes, for example, thermo plastic elastomers (TPE). The piston 4 has, for example, a recess 4*b* at both one end and the other end thereof in the axial direction D1. The recess 4*b* located on the front side is filled with the coating material M, and the movable body 5 is inserted in the recess 4*b* located on the rear side.

Figure 5:
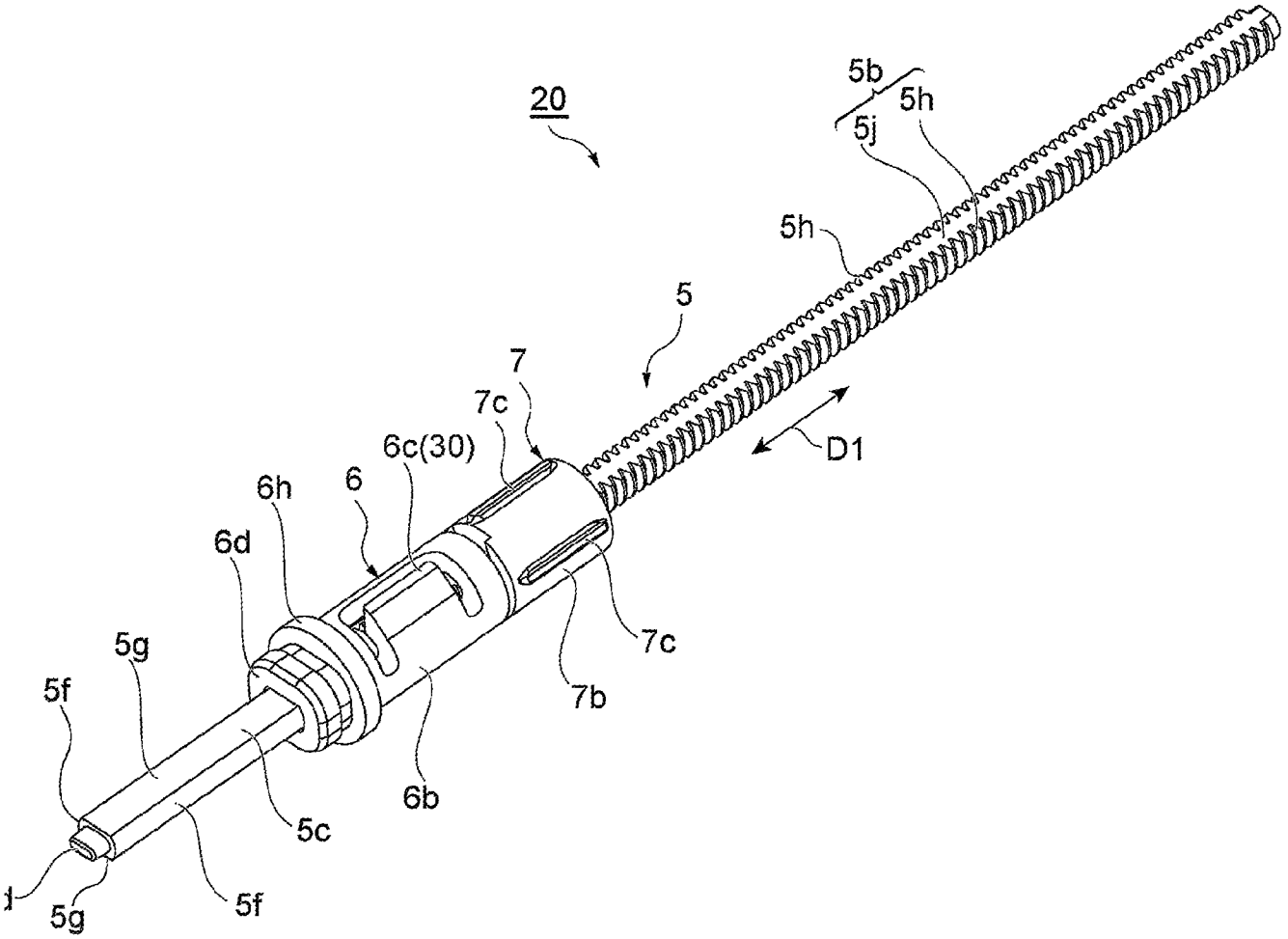
FIG. 5 is a perspective view depicting a movable body, a tubular member, and a female screw member of the coating material feeding container of FIG. 1.

FIG. 5 is a perspective view depicting a feeding mechanism 20 of the coating material feeding container 1 configured by assembling the movable body 5, the tubular member 6, and the female screw member 7. As depicted in FIGS. 3 and 5, the feeding mechanism 20 includes the movable body 5 having male screws 5*h*, the tubular member 6 in and through which the movable body 5 is inserted and passed and which is engaged with the movable body 5 in a synchronously rotatable manner, and the tubular female screw member 7 with which the male screws 5*h* of the movable body 5 are coupled in screw engagement.

The female screw member 7 includes, for example, a polyacetal resin (POM resin). An outer surface 7*b* of the female screw member 7 is formed with a projection 7*c* which is to be engaged with the container rear portion 3 in the rotating direction and extends in the axial direction D1. The female screw member 7 has, for example, a plurality of (for example, four) projections 7*c*, and the plurality of projections 7*c* are formed to be aligned at regular intervals in the circumferential direction of the female screw member 7. An inner surface of the female screw member 7 is formed with a female screw 7*d*, and the male screws 5*h* of the movable body 5 are coupled with the female screw 7*d* in screw engagement.

The tubular member 6 includes, for example, a POM resin. On an outer surface 6*b* of the tubular member 6, there is provided a first projection 6*c* having elasticity in a radial direction D2 (see FIGS. 7A and 7B) of the tubular member 6. The first projection 6*c* constitutes a ratchet mechanism 30 together with a second projection 3*m* of the container rear portion 3 to be described later. The configurations of the first projection 6*c*, the second projection 3*m*, and the ratchet mechanism 30 will be described in detail later.

The movable body 5 includes, for example, a POM resin. The movable body 5 is rod-like in shape. The movable body 5 has a male screw portion 5*b* screw-engaged with the female screw member 7, and an insertion portion 5*c* inserted in the tubular member 6. The insertion portion 5*c* is provided at a front portion of the movable body 5. The shape of a cross section of the insertion portion 5*c* obtained when cut in a plane orthogonal to the axial direction D1 is non-circular.

At an end portion of the insertion portion 5*c* in the axial direction D1, there is formed a projection 5*d* projecting in the axial direction D1. The shape of the projection 5*d* as viewed along the axial direction D1 is, for example, an ellipse. The projection 5*d* is a part fitted into the rear-side recess 4*b* of the piston 4. With the projection 5*d* fitted into the recess 4*b*, the movable body 5 advances together with the piston 4.

The shape of the insertion portion 5*c* as viewed along the axial direction D1 is non-circular. The insertion portion 5*c* has a pair of curved surfaces 5*f* curved to the outside of the movable body 5, and a pair of cut surfaces 5*g* for connection between end portions of the pair of curved surfaces 5*f*. The curved surfaces 5*f* are, for example, curved in an arcuate shape. The cut surfaces 5*g* are, for example, in the shape of a segment of a circle obtained by cutting off a part of an arcuate portion. As an example, the cut surfaces 5*g* are flat surfaces.

The male screw portion 5*b* has the male screws 5*h* formed on one side and the other side of the movable body 5 in a width direction, and cut surfaces 5*j* formed between the pair of male screws 5*h*. The male screws 5*h* are, for example, provided on the rear side of the curved surfaces 5*f* of the insertion portion 5*c*, and the cut surfaces 5*j* are provided on the rear side of the cut surfaces 5*g*.

The movable body 5 configured as above is inserted in and passed through the tubular member 6 and the female screw member 7 and is engaged with the tubular member 6 in the rotating direction. With the male screws 5*h* in screw engagement with the female screw member 7, the movable body 5 advances with respect to the female screw member 7 and the tubular member 6 attendant on relative rotation of the container front portion 2 and the container rear portion 3.

Figure 6:
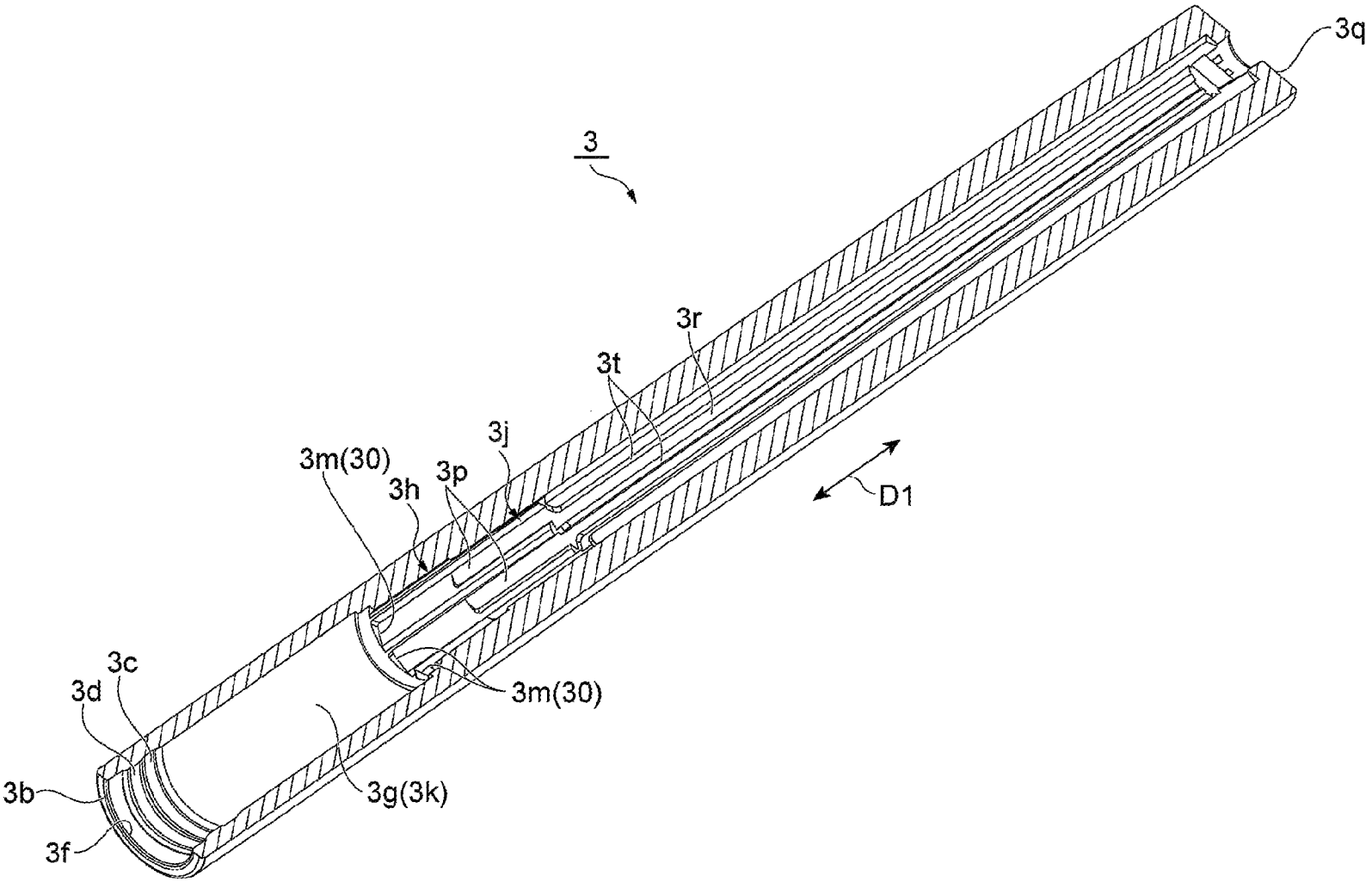
FIG. 6 is a cross-sectional perspective view of a container rear portion of the coating material feeding container of FIG. 1.

FIG. 6 is a cross-sectional perspective view of the container rear portion 3. The container rear portion 3 includes, for example, an acrylonitrile butadiene styrene (ABS) resin. As depicted in FIGS. 3 and 6, the container rear portion 3 has a tubular shape extending in the axial direction D1. The container rear portion 3 has an opening 3*f* into which the feeding mechanism 20 is inserted, on an inner side of the end surface 3*b*. At positions near the opening 3*f* on the inner surface 3*g* of the container rear portion 3, there are formed the annular recess 3*c* with which the annular projection 2*g* of the container front portion 2 is engaged in the axial direction D1 and an annular projection 3*d*.

The container rear portion 3 has a tubular member engaging portion 3*h* and a female screw member engaging portion 3*j* which are formed on the inner surface 3*g*. Between the annular recess 3*c* and the tubular member engaging portion 3*h* of the container rear portion 3, a smooth (stepless) curved surface 3*k* facing an outer circumferential surface of the container front portion 2 is formed. The tubular member engaging portion 3*h* has the second projection 3*m* for engagement with the tubular member 6 in the rotating direction. The container rear portion 3 has, for example, a plurality of (for example, eight) second projections 3*m*. The second projections 3*m* constitute the ratchet mechanism 30 together with the first projection 6*c* of the tubular member 6 described above.

On the rear side of the tubular member engaging portion 3*h*, the female screw member engaging portion 3*j* is provided. The female screw member engaging portion 3*j* has a projection 3*p* with which one of the projections 7*c* of the female screw member 7 is engaged in the rotating direction. For example, the projection 3*p* projects from corresponding one of the second projections 3*m* inward in the radial direction of the container rear portion 3. The container rear portion 3 has, for example, a plurality of projections 3*p*, and the plurality of projections 3*p* are disposed in such a manner as to be aligned at regular intervals in the circumferential direction of the container rear portion 3.

Between the female screw member engaging portion 3*j* and an end portion 3*q* (rear end) of the container rear portion 3 in the axial direction D1, there is provided a movable body insertion portion 3*r* in which the movable body 5 is inserted. The movable body insertion portion 3*r* is formed with a projection 3*t* extending in the axial direction D1. For example, the movable body insertion portion 3*r* has a plurality of projections 3*t*.

Figure 7A:
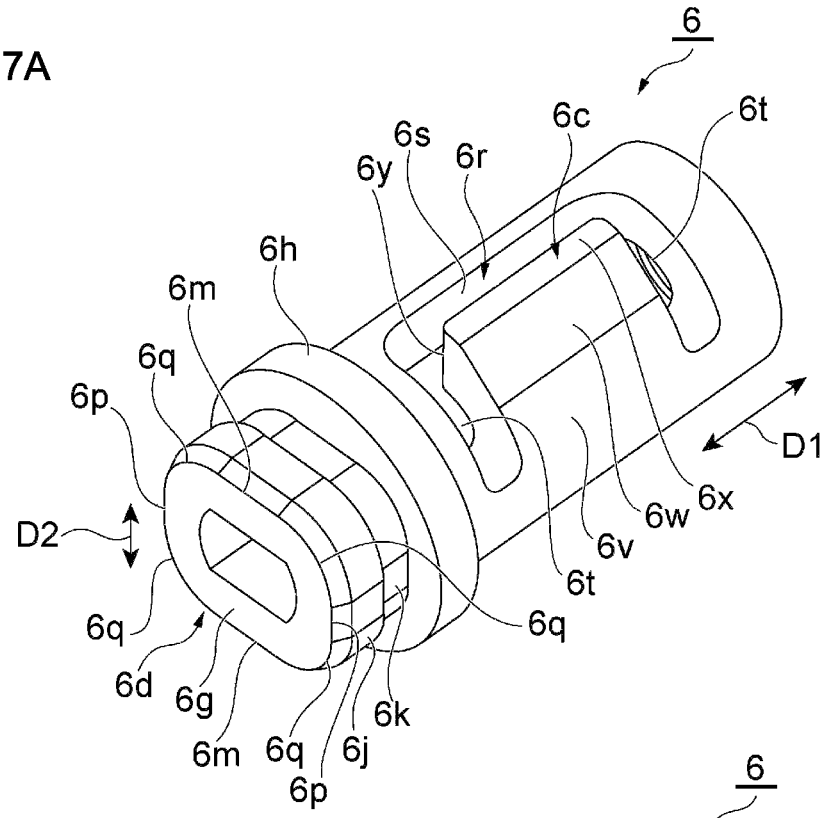
FIG. 7A is a perspective view, as viewed from a front side, of the tubular member of FIG. 5.
Figure 7B:
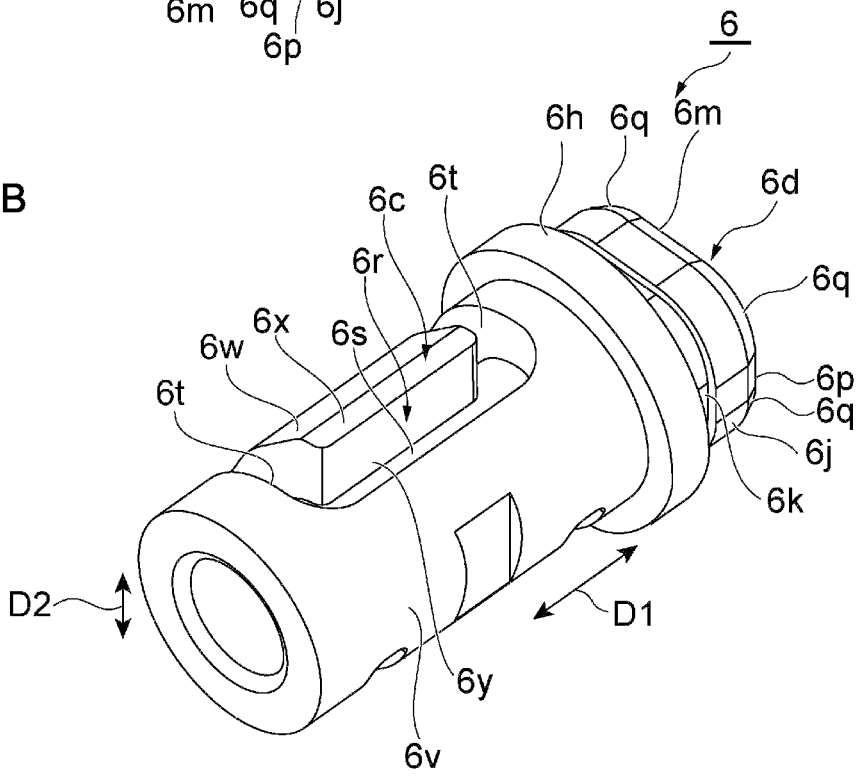
FIG. 7B is a perspective view, as viewed from a rear side, of the tubular member of FIG. 5.

FIG. 7A is a perspective view, as viewed from one side (front side) in the axial direction D1, of the tubular member 6. FIG. 7B is a perspective view, as viewed from the other side (rear side) in the axial direction D1, of the tubular member 6. The tubular member 6 has a fixed portion 6*d* fixed to the fixing portion 2*h* of the container front portion 2, at one end in the axial direction D1. The fixed portion 6*d* projects in the axial direction D1 at one end of the tubular member 6 in the axial direction D1.

The tubular member 6 has, for example, a flange portion 6*h* on the opposite side of an end surface 6*g* of the tubular member 6 as viewed from the fixed portion 6*d*. In addition, the fixed portion 6*d* has an expansion portion 6*j* located at one end of the tubular member 6 in the axial direction D1, and a base portion 6*k* located on the opposite side (the flange portion 6*h* side) of the expansion portion 6*j* from the end surface 6*g*. Since the fixed portion 6*d* has the expansion portion 6*j* in this manner, the fixed portion 6*d* can be firmly fixed to the fixing portion 2*h* of the container front portion 2.

The shape of the fixed portion 6*d* as viewed along the axial direction D1 is similar to the shape of the fixing portion 2*h* of the container front portion 2. In other words, the shape of the fixed portion 6*d* as viewed along the axial direction D1 is non-circular, for example, a corner-rounded rectangle. The fixed portion 6*d* has a pair of first straight line portions 6*m* extending in parallel to each other, a pair of second straight line portions 6*p* extending in parallel to each other in a direction different from the first straight line portions 6*m*, and four curved portions 6*q* curved to the outside of the fixed portion 6*d* between the first straight line portions 6*m* and the second straight line portions 6*p*. The fixed portion 6*d* formed in this way is fixed to the fixing portion 2*h* of the container front portion 2 by being inserted into the fixing portion 2*h* along the axial direction D1. In this instance, the flange portion 6*h* of the tubular member 6 is in the state of facing a rear end 2*t* (see FIG. 3) of the container front portion 2 along the axial direction D1.

The tubular member 6 has a through-hole 6*r* penetrating the tubular member 6 in the radial direction D2 of the tubular member 6 in the periphery of the first projection 6*c*. The first projection 6*c* has elasticity in the radial direction D2 of the tubular member 6 owing to the through-hole 6*r*. The through-hole 6*r* is defined, for example, by a first hole portion 6*s* extending in the axial direction D1 and a pair of second hole portions 6*t* extending from one end and the other end of the first hole portion 6*s* in the circumferential direction of the tubular member 6.

The through-hole 6*r* is roughly U-shaped by having the first hole portion 6*s* and the pair of second hole portions 6*t* aligned in the axial direction D1. Owing to the structure in which the first projection 6*c* is formed at a position adjacent to the first hole portion 6*s* and between the pair of second hole portions 6*t*, the first projection 6*c* has elasticity in the radial direction D2 of the tubular member 6. The first projection 6*c* has, for example, an inclined surface 6*w* projecting obliquely upward continuously from an outer circumferential surface 6*v* of the tubular member 6, a top surface 6*x* located between the inclined surface 6*w* and the first hole portion 6*s*, and a wall surface 6*y* defining the first hole portion 6*s*.

Figure 8:
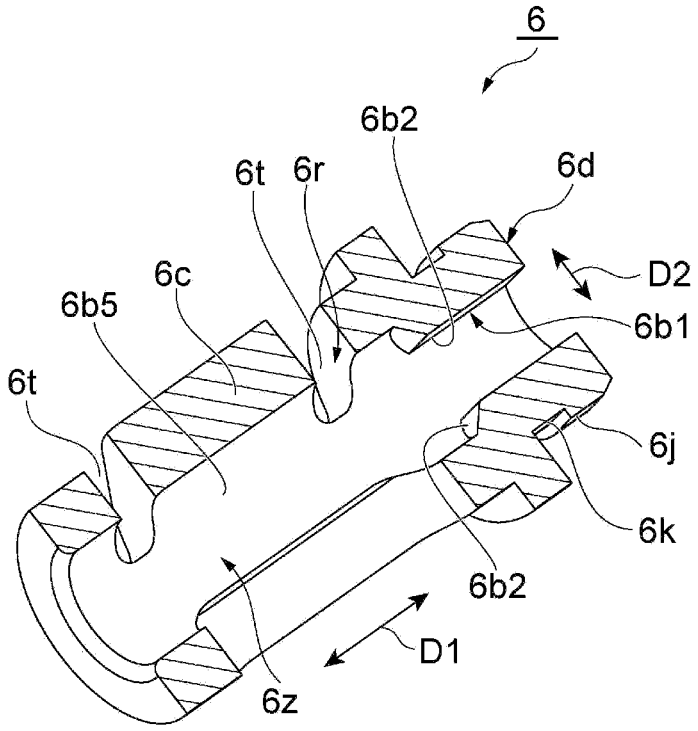
FIG. 8 is a cross-sectional perspective view of the tubular member of FIG. 5.
Figure 9:
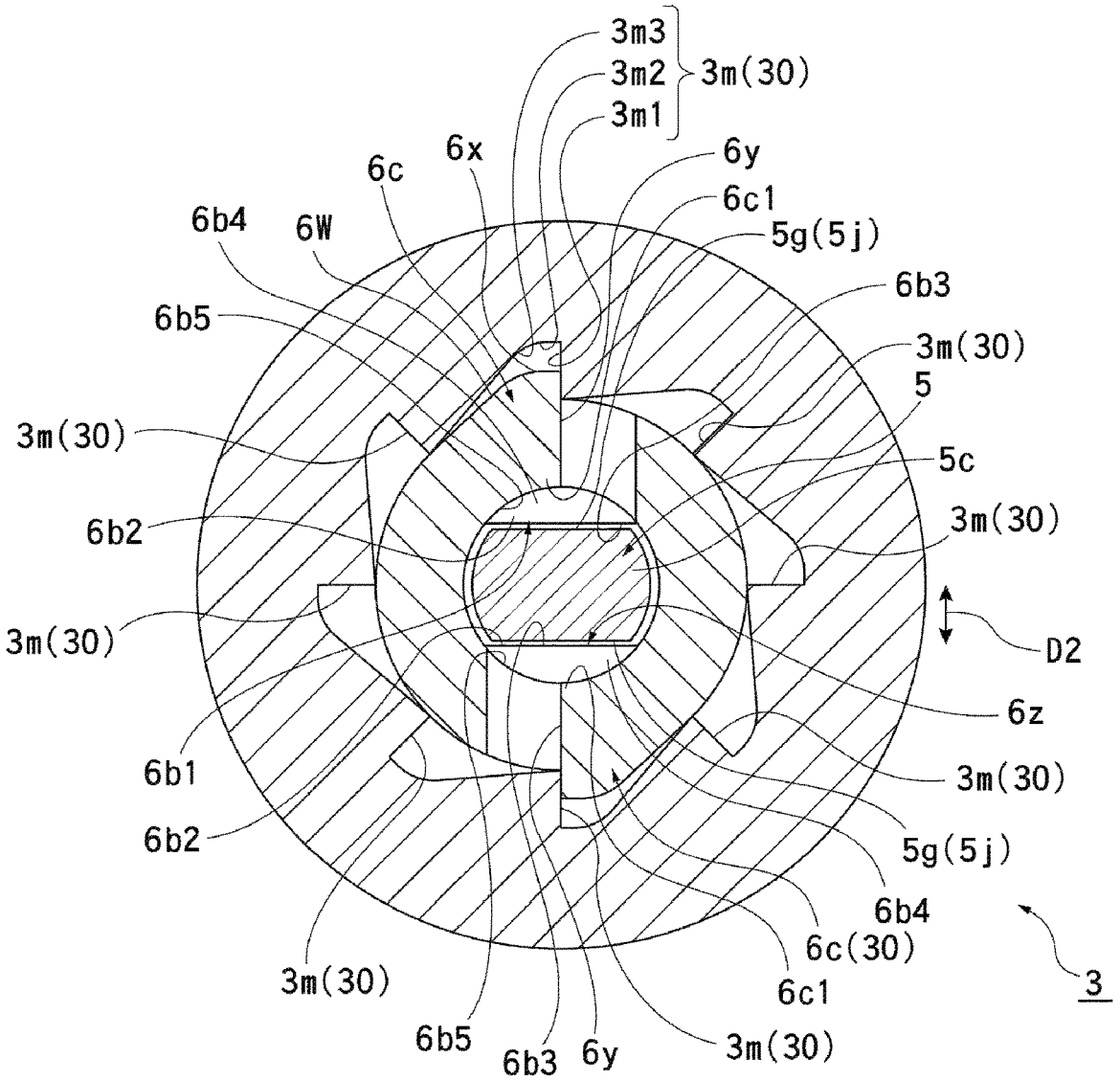
FIG. 9 is a cross-sectional view taken along line B-B of FIG. 3.

FIG. 8 is a cross-sectional perspective view of the tubular member 6. FIG. 9 is a cross-sectional view taken along line B-B of FIG. 3. As depicted in FIGS. 8 and 9, the tubular member 6 has a tube hole 6*z* in and through which the movable body 5 is inserted and passed. The tube hole 6*z* penetrates the tubular member 6 along the axial direction D1. The tubular member 6 has a small-diameter portion 6*b*1 projecting inward in the radial direction D2 of the tubular member 6.

The small-diameter portion 6*b*1 refers to a portion where an inside diameter of the tube hole 6*z* of the tubular member 6 is smaller than that of the other portions. The small-diameter portion 6*b*1 is provided at one end (front end) of the tubular member 6 in the axial direction D1. The small-diameter portion 6*b*1 is formed in the tube hole 6*z* by a projecting portion 6*b*2 projecting inward in the radial direction D2 of the tubular member 6. The tubular member 6 has, for example, two projecting portions 6*b*2, and the two projecting portions 6*b*2 face each other along the radial direction D2 of the tubular member 6.

The insertion portion 5*c* of the movable body 5 is inserted in and passed through the tube hole 6*z* of the tubular member 6, and the insertion portion 5*c* inserted in and passed through the tube hole 6*z* is engaged with the small-diameter portion 6*b*1. In this instance, the insertion portion 5*c* is engaged with an inner surface 6*b*3 of the small-diameter portion 6*b*1 in the rotating direction in such a manner that the cut surfaces 5*g* and 5*j* of the insertion portion 5*c* face the inner surface 6*b*3, so that the tubular member 6 and the movable body 5 are engaged with each other in a synchronously rotatable manner.

The second projections 3*m* of the container rear portion 3 that are engaged with the tubular member 6 are each defined by, for example, a contact surface 3*m*1 extending in the radial direction D2, a bottom surface 3*m*2 extending in the circumferential direction of the container rear portion 3 on an outer side of the contact surface 3*m*1 in the radial direction D2, and an inclined surface 3*m*3 extending from the side of the bottom surface 3*m*2 opposite to the contact surface 3*m*1 in a direction inclined with respect to the radial direction D2. The contact surface 3*m*1 is a surface with which the wall surface 6*y* of the first projection 6*c* of the tubular member 6 makes contact. The inclined surface 3*m*3 extends, for example, in a direction orthogonal to the adjacent contact surface 3*m*1.

With the above-described configuration, the container rear portion 3 is rotated in one direction (clockwise direction in FIG. 9) with respect to the tubular member 6 and the movable body 5. However, the container rear portion 3 is not rotated in the other direction opposite to the one direction with respect to the tubular member 6 and the movable body 5. In addition, the tube hole 6*z* has, between the first projection 6*c* and the cut surfaces 5*g* and 5*j* of the movable body 5, a space portion 6*b*4 for allowing the first projection 6*c* to be displaced inward in the radial direction D2.

The position of the space portion 6*b*4 in the axial direction D1 is different from the position of the small-diameter portion 6*b*1 in the axial direction D1. The space portion 6*b*4 is formed between an inner surface 6*b*5 formed in a circular shape of the tube hole 6*z* and the cut surfaces 5*g* and 5*j* of the movable body 5 inserted in and passed through the tube hole 6*z*. Thus, in the present embodiment, the space portion 6*b*4 between the inner surface 6*b*5 of the tube hole 6*z* and the cut surfaces 5*g* and 5*j* of the movable body 5 can be utilized as a region for allowing the first projection 6*c* to be displaced in the radial direction D2.

Next, an example of a method of using the coating material feeding container 1 will be described. First, as depicted in FIGS. 2 and 3, the cap 10 is detached, and the container front portion 2 is exposed. Then, when the container rear portion 3 is relatively rotated in one direction with respect to the container front portion 2, the female screw member 7 is rotated together with the container rear portion 3, and, the tubular member 6 and the movable body 5 are rotated together with the container front portion 2. Therefore, the female screw member 7 is relatively rotated in one direction with respect to the movable body 5, so that a screw engagement action of the male screws 5*h* and the female screw 7*d* functions such that the movable body 5 advances with respect to the female screw member 7.

When the movable body 5 advances with respect to the female screw member 7, the piston 4 and the coating material M advance attendant on the advance of the movable body 5, and the coating material M is fed out from the container front portion 2. In addition, when the container rear portion 3 is relatively rotated in one direction with respect to the container front portion 2, as depicted in FIG. 9, the container rear portion 3 is rotated in one direction (clockwise in FIG. 9) with respect to the tubular member 6, and the container rear portion 3 is moved in the one direction while the inclined surface 3*m*3 of the container rear portion 3 is in contact with the inclined surface 6*w* of the tubular member 6.

In this instance, the first projection 6*c* is bent inward in the radial direction D2 of the tubular member 6, and an inner end portion 6*c*1 of the first projection 6*c* in the radial direction D2 enters into the space portion 6*b*4. Then, when the container rear portion 3 is further rotated in the one direction, the inclined surface 3*m*3 comes over the top surface 6*x* of the first projection 6*c* in the one direction, and the first projection 6*c* is returned from the bent state to the original state. Since a sense of resistance is generated together with a click sound when the inclined surface 3*m*3 comes over the top surface 6*x*, the user can feed the coating material M while generating click sounds of ticktock.

When the container rear portion 3 is to be relatively rotated in the other direction with respect to the container front portion 2, the container rear portion 3 is supposed to rotate in the other direction (counterclockwise in FIG. 9) with respect to the tubular member 6. However, when the container rear portion 3 is to rotate in the other direction with respect to the tubular member 6, the contact surface 3*m*1 of the container rear portion 3 makes contact with the wall surface 6*y* of the tubular member 6, so that the rotation of the container rear portion 3 in the other direction is restricted. Therefore, relative rotation of the container rear portion 3 in the other direction with respect to the container front portion 2 is restricted.

Next, operational effects obtained from the coating material feeding container 1 according to the present embodiment will be described in detail. As depicted in FIGS. 3 and 9, in the coating material feeding container 1, the tubular container front portion 2 and the tubular container rear portion 3 are engaged with each other in a relatively rotatable manner. The coating material M is disposed inside the container front portion 2, and the movable body 5 having the male screws 5*h* at its outer peripheral portion is disposed on the rear side of the coating material M. The tubular female screw member 7 including the female screw 7*d* to be screw-engaged with the male screws 5*h* of the movable body 5 is disposed inside the container rear portion 3. When the container front portion 2 and the container rear portion 3 are relatively rotated, the screw engagement action of the male screws 5*h* of the movable body 5 and the female screw 7*d* of the female screw member 7 functions such that the movable body 5 advances with respect to the female screw member 7, so that the advancing movable body 5 pushes the coating material M disposed inside the container front portion 2 forward, and thus, the coating material M is fed out from the container front portion 2.

The tubular member 6 having the first projection 6*c* at the outer surface 6*b* is disposed inside the container rear portion 3 between the container front portion 2 and the female screw member 7. The through-hole 6*r* is formed in the periphery of the first projection 6*c* of the tubular member 6, and the first projection 6*c* has elasticity in the radial direction D2 owing to the through-hole 6*r*. In other words, the first projection 6*c* can be elastically deformed in the radial direction D2 of the tubular member 6.

The inner surface 3*g* of the container rear portion 3 is formed with the second projections 3*m* to be engaged with the first projection 6*c* in the rotating direction. The first projection 6*c* normally (constantly) makes contact with one of the second projections 3*m*, which normally generates a resistance between the tubular member 6 and the container rear portion 3. The tubular member 6 has the small-diameter portion 6*b*1 projecting inward in the radial direction D2, and the movable body 5 inserted in and passed through the tube hole 6*z* of the tubular member 6 is engaged with the small-diameter portion 6*b*1.

The movable body 5 has the insertion portion 5*c* that is inserted in and passed through the tube hole 6*z* of the tubular member 6 and is engaged with the small-diameter portion 6*b*1. The insertion portion 5*c* has the cut surfaces 5*g* and 5*j* that are engaged with the inner surface 6*b*3 of the small-diameter portion 6*b*1 and extend in the axial direction D1 in the tube hole 6*z*. The space portion 6*b*4 where the first projection 6*c* can be elastically deformed inward in the radial direction D2 is formed between the first projection 6*c* and the cut surfaces 5*g* and 5*j* of the movable body 5 in the tube hole 6*z*. Therefore, the first projection 6*c* of the tubular member 6 is engaged with one of the second projections 3*m* of the container rear portion 3 on the inner side of the second projection 3*m* in the radial direction D2, and the cut surfaces 5*g* and 5*j* of the movable body 5 are disposed on the inner side of the first projection 6*c* in the radial direction D2, so that the length of the tubular member 6 in the axial direction D1 can be reduced.

Therefore, by disposing the tubular member 6 that is small in length in the axial direction D1, the coating material M long in the axial direction D1 can be loaded, so that the coating material feeding container 1 can be filled with a larger amount of the coating material M. In addition, since the length in the axial direction D1 of the tubular member 6 engaged with each of the container rear portion 3 and the movable body 5 is suppressed, the coating material feeding container 1 can be made compact.

Figure 10:
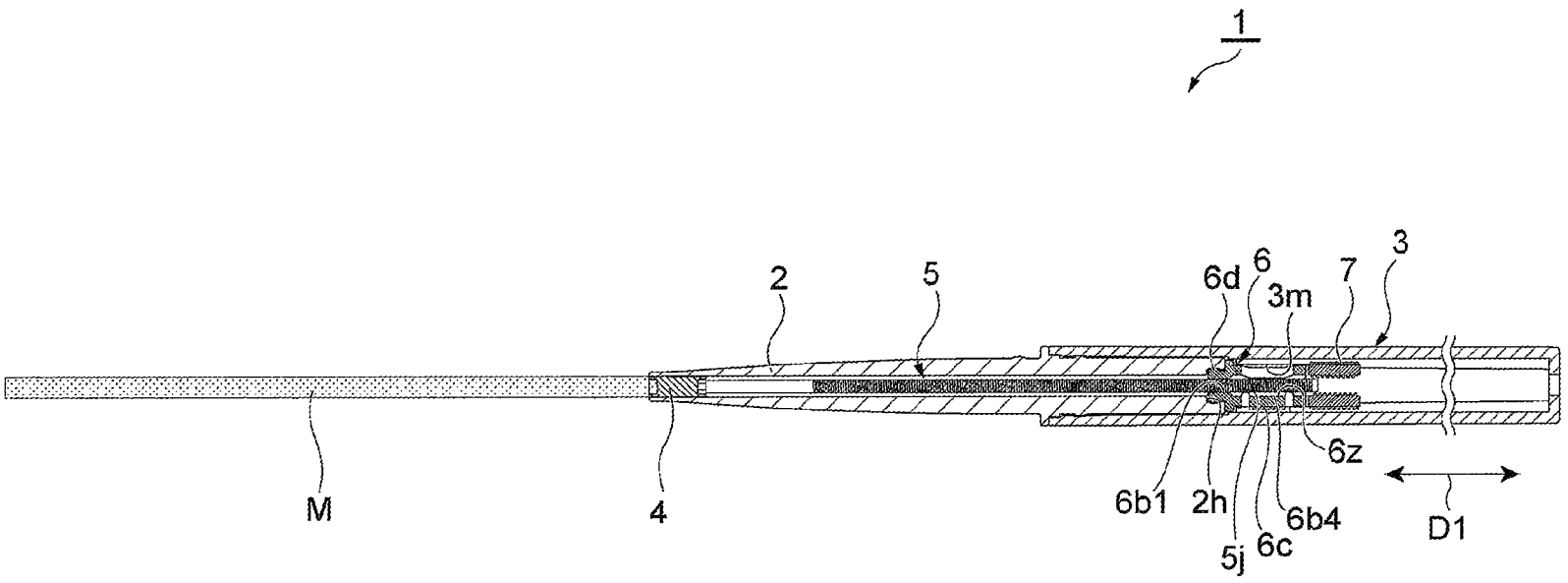
FIG. 10 is a cross-sectional view depicting a state in which the cap has been detached from the coating material feeding container of FIG. 3 and a coating material is fed.
Figure 11A:
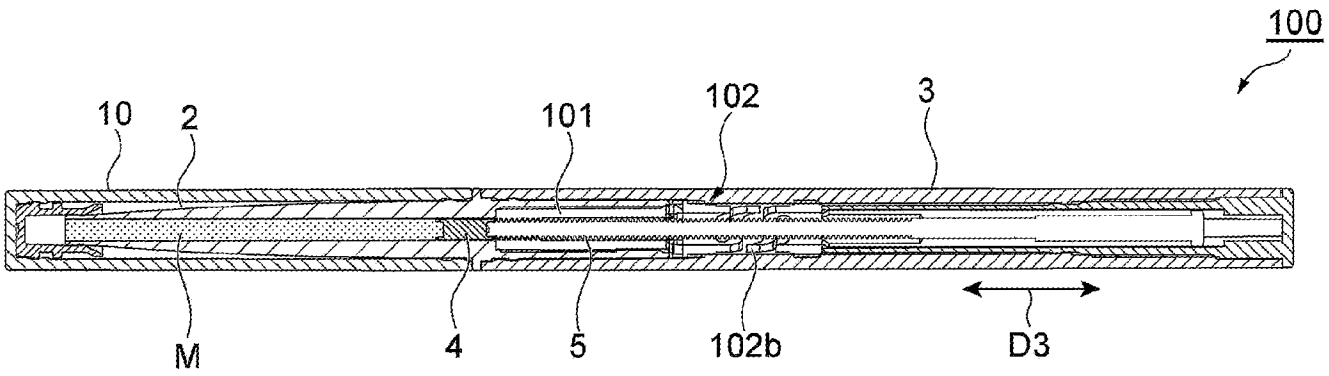
FIGS. 11A and 11B are cross-sectional views depicting a coating material feeding container according to a comparative example.
Figure 11B:
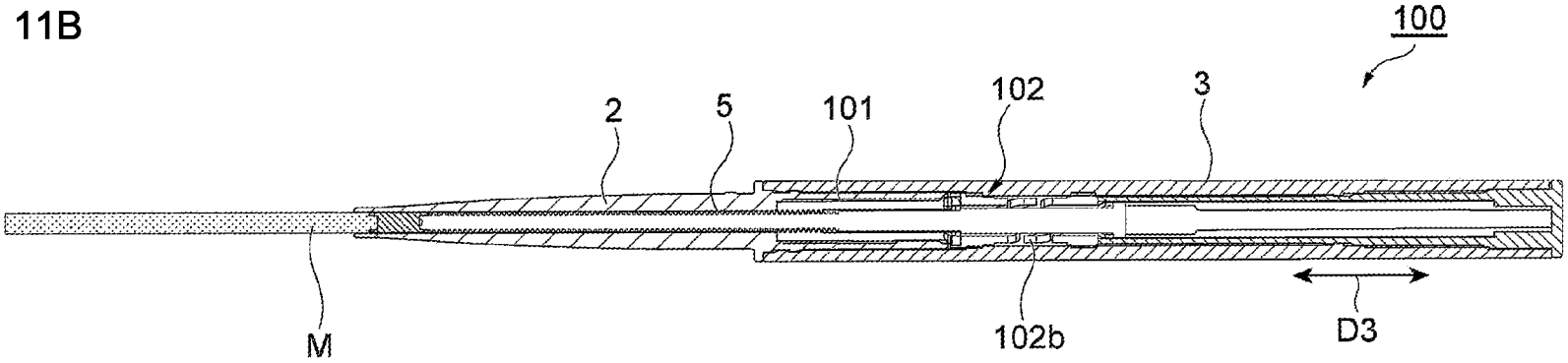

FIG. 10 is a cross-sectional view depicting a state in which the coating material M in the coating material feeding container 1 is fed out and the movable body 5 is moved to a limit of advancing movement. FIGS. 11A and 11B are cross-sectional views depicting a coating material feeding container 100 according to a comparative example. The coating material feeding container 100 according to the comparative example includes a container front portion 2, a container rear portion 3, a piston 4, a movable body 5, and a cap 10 similar to those in the coating material feeding container 1, but component parts disposed inside the container front portion 2 and the container rear portion 3 are different from those of the coating material feeding container 1.

The coating material feeding container 100 includes, in place of the tubular member 6 and the female screw member 7 of the coating material feeding container 1, a tubular female screw member 101 accommodated in the container front portion 2 and a spring member 102 ratchet-engaged with the female screw member 101 in a rear portion of the female screw member 101. The spring member 102 has a tubular shape opening at both ends. An intermediate portion in the axial direction of the spring member 102 is formed with a spiral spring portion 102*b* that contracts in an axial direction D3 of the spring member 102 to absorb an impact. In the coating material feeding container 100 according to the comparative example, a region where the spring member 102 that contracts and extends in the axial direction D3 is disposed needs to be secured inside the container rear portion 3, and there is a problem in which a coating material M long in the axial direction D3 cannot be loaded.

On the other hand, the coating material feeding container 1 according to the present embodiment includes the movable body 5, the tubular member 6, and the female screw member 7, and the tubular member 6 has the tube hole 6*z* in which is formed the small-diameter portion 6*b*1 to be engaged with the insertion portion 5*c* of the movable body 5. Besides, the space portion 6*b*4 where the first projection 6*c* can be elastically deformed inward in the radial direction D2 is formed in the tube hole 6*z* between the first projection 6*c* and the cut surfaces 5*g* and 5*j* of the movable body 5. Therefore, the first projection 6*c* of the tubular member 6 is engaged with one of the second projections 3*m* of the container rear portion 3 on the inner side of the second projection 3*m* in the radial direction D2, and the cut surfaces 5*g* and 5*j* of the movable body 5 are disposed on the inner side of the first projection 6*c* in the radial direction D2, so that the length of the tubular member 6 in the axial direction D1 can be reduced. By thus disposing the tubular member 6 that is small in length in the axial direction D1, the coating material M long in the axial direction D1 can be loaded. Therefore, the coating material feeding container 1 can be filled with the coating material M in an amount larger than that in the coating material feeding container 100 according to the comparative example, in a state in which the coating material feeding container 1 is not enlarged and is maintained in a compact state.

The tubular member 6 according to the present embodiment has the fixed portion 6*d* fixed to the container front portion 2, and a cross section of the fixed portion 6*d* orthogonal to the axial direction D1 is non-circular in shape. The container front portion 2 has the fixing portion 2*h* to which the fixed portion 6*d* is fixed, and a cross section of the fixing portion 2*h* orthogonal to the axial direction D1 is similar in shape to the cross section of the fixed portion 6*d* orthogonal to the axial direction D1. Therefore, when the fixed portion 6*d* of the tubular member 6 is fixed to the fixing portion 2*h* of the container front portion 2, the fixed portion 6*d* is fitted into the non-circular fixing portion 2*h*, so that the tubular member 6 can be engaged with the container front portion 2 in a synchronously rotatable manner.

As depicted in FIG. 3, the coating material M according to the present embodiment is hardened in the state of making close contact with the inner surface 2*s* of the container front portion 2. Therefore, since the coating material M is in close contact with the inner surface 2*s* of the container front portion 2, even a soft coating material M can be securely protected in the container front portion 2. In other words, breakage of the coating material M inside the container front portion 2 can be more securely restrained.

As depicted in FIG. 9, in the present embodiment, the first projection 6*c* and the second projections 3*m* constitute the ratchet mechanism 30 that permits relative rotation in one direction of the container front portion 2 and the container rear portion 3 but restricts relative rotation in the other direction opposite to the one direction. Therefore, the movable body 5 advances attendant on the relative rotation in one direction of the container front portion 2 and the container rear portion 3, and the relative rotation in the other direction is restricted by the ratchet mechanism 30. Therefore, relative rotation in the other direction of the container front portion 2 and the container rear portion 3 and an unintended retraction of the coating material M and the movable body 5 can be restricted.

In the present embodiment, the first projection 6*c* normally makes contact with one of the second projections 3*m*, which normally generates a resistance between the tubular member 6 and the container rear portion 3. In the case where the first projection 6*c* projecting from the outer surface 6*b* of the tubular member 6 is normally in contact with one of the second projections 3*m* projecting from the inner surface 3*g* of the container rear portion 3 in this manner, a resistance can be normally generated between the tubular member 6 and the container rear portion 3, so that backlash of the tubular member 6 and the container rear portion 3 can be restrained.

The coating material feeding container according to the embodiment of the present disclosure has been described above. However, the coating material feeding container according to the present disclosure is not limited to the above-described embodiment and can be modified in such a range as not to change the gist described in the claims and, further, can be one that is used for other things. In other words, the configuration, shape, size, material, and layout of each component part constituting the coating material feeding container can be modified as required within the scope of the above-described gist.

For example, the above embodiment describes the example in which the small-diameter portion 6*b*1 is formed in the tube hole 6*z* by the projecting portion 6*b*2 projecting inward in the radial direction D2 of the tubular member 6, and the tubular member 6 has two projecting portions 6*b*2. Alternatively, the number of small-diameter portions and projecting portions of the tubular member may be one or equal to or more than three, and can be changed as required.

For example, the above embodiment describes the coating material feeding container 1 in which relative rotation in one direction is possible and only feeding of the coating material M is conducted. Alternatively, the coating material feeding container according to the present disclosure may be a coating material feeding container capable of relative rotation in both one direction and the other direction opposite to the one direction.

Figure 12:
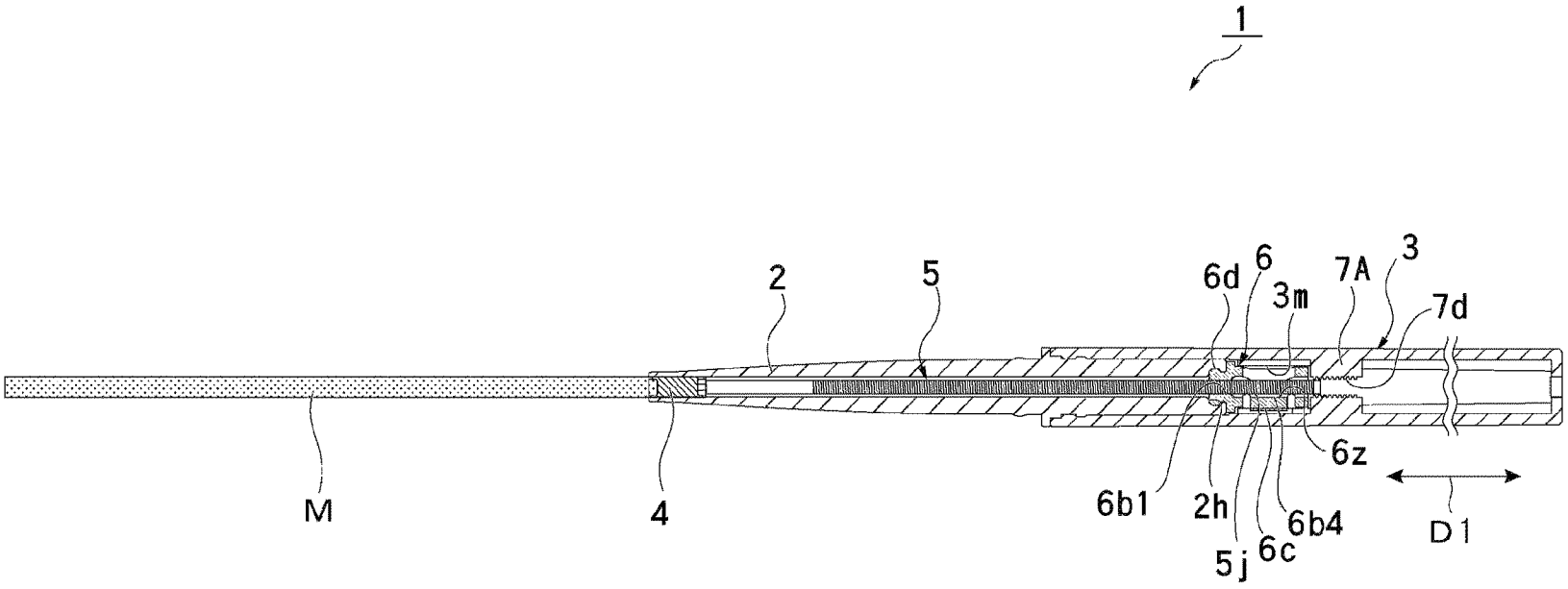
FIG. 12 is a cross-sectional view depicting a configuration example in which the container rear portion of the coating material feeding container according to the embodiment has a female screw.

For example, the above embodiment describes the example in which the coating material feeding container 1 includes the tubular female screw member 7 located inside the container rear portion 3 and the female screw member 7 has the female screw 7*d* formed at an inner peripheral portion thereof. Alternatively, for example, the coating material feeding container 1 according to the present disclosure may have a configuration in which the container rear portion 3 and the female screw member 7 are integrally molded with each other, the female screw member 7 is formed as a female screw portion 7A constituting part of the container rear portion 3, and the container rear portion 3 has the female screw 7*d* formed at an inner peripheral portion thereof (see FIG. 12). In this case, high strength of the female screw portion 7A (female screw 7*d*) can be secured and, at the same time, the number of parts and steps for manufacturing the coating material feeding container 1 can be reduced.

Further, the above embodiment describes the example in which the coating material M is a volatile rod-shaped cosmetic material. Alternatively, the coating material according to the present disclosure may be a coating material other than the cosmetic material. The coating material according to the present disclosure may be one used as a lip gloss, a lipstick, an eyeshadow, an eyeliner, stationery (drawing material) such as a marking pen, medication, or a coating material containing a slurry substance, and these coating materials can also be applied to the coating material feeding container according to the present disclosure.

What is claimed is:

1. A coating material feeding container comprising:

a tubular container front portion;

a tubular container rear portion rotatable with respect to the container front portion;

a movable body that is disposed on a rear side of a coating material located inside the container front portion and has a male screw at an outer peripheral portion thereof;

a tubular female screw member that is located inside the container rear portion and has a female screw for screw engagement with the male screw at an inner peripheral portion thereof; and a tubular member that is disposed inside the container rear portion between the container front portion and the female screw member, wherein a screw engagement action of the male screw and the female screw functions, attendant on relative rotation of the container front portion and the container rear portion, such that the movable body advances with respect to the female screw member, to thereby feed the coating material from the container front portion, a first projection is provided on an outer surface of the tubular member, at least one second projection for engagement with the first projection in a rotating direction of the container rear portion is provided on an inner surface of the container rear portion, the first projection has elasticity in a radial direction of the tubular member by a through-hole that penetrates the tubular member in a periphery of the first projection in the radial direction, the tubular member has a small-diameter portion that projects inward in the radial direction of the tubular member and is engaged with the movable body, the movable body has an insertion portion that is inserted in and passed through a tube hole of the tubular member and is engaged with the small-diameter portion, the insertion portion has a cut surface that is engaged with an inner surface of the small-diameter portion and extends in the tube hole in an axial direction of the tube hole, and the tube hole has a space portion for allowing the first projection to be displaced inward in the radial direction, between the first projection and the cut surface.

2. The coating material feeding container according to claim 1, wherein the tubular member has a fixed portion fixed to the container front portion, a cross section of the fixed portion orthogonal to the axial direction is non-circular in shape, the container front portion has a fixing portion to which the fixed portion is fixed, and a cross section of the fixing portion orthogonal to the axial direction is similar in shape to the cross section of the fixed portion orthogonal to the axial direction.

3. The coating material feeding container according to claim 1, wherein the coating material is hardened in a state of making close contact with an inner surface of the container front portion.

4. The coating material feeding container according to claim 1, wherein the first projection and the at least one second projection constitute a ratchet mechanism that permits relative rotation in one direction of the container front portion and the container rear portion but restricts relative rotation in another direction opposite to the one direction.

5. The coating material feeding container according to claim 4, wherein the first projection is normally in contact with one of the at least one second projection to thereby normally generate a resistance between the tubular member and the container rear portion.

6. The coating material feeding container according to claim 1, wherein the first projection is normally in contact with one of the at least one second projection to thereby normally generate a resistance between the tubular member and the container rear portion.

7. A coating material feeding container comprising:

a tubular container front portion;

a tubular container rear portion rotatable with respect to the container front portion;

a movable body that is disposed on a rear side of a coating material located inside the container front portion and has a male screw at an outer peripheral portion thereof; and a tubular member that is disposed inside the container rear portion on a rear side of the container front portion, wherein the container rear portion has a female screw for screw engagement with the male screw at an inner peripheral portion thereof, a screw engagement action of the male screw and the female screw functions, attendant on relative rotation of the container front portion and the container rear portion, such that the movable body advances to feed the coating material from the container front portion, a first projection is provided on an outer surface of the tubular member, at least one second projection for engagement with the first projection in a rotating direction of the container rear portion is provided on an inner surface of the container rear portion, the first projection has elasticity in a radial direction of the tubular member by a through-hole that penetrates the tubular member in a periphery of the first projection in the radial direction, the tubular member has a small-diameter portion that projects inward in the radial direction of the tubular member and is engaged with the movable body, the movable body has an insertion portion that is inserted in and passed through a tube hole of the tubular member and is engaged with the small-diameter portion, the insertion portion has a cut surface that is engaged with an inner surface of the small-diameter portion and extends in the tube hole in an axial direction of the tube hole, and the tube hole has a space portion for allowing the first projection to be displaced inward in the radial direction, between the first projection and the cut surface.

* * * * *